US010962021B2

(12) United States Patent
Mazur

(10) Patent No.: US 10,962,021 B2
(45) Date of Patent: Mar. 30, 2021

(54) NON-AXISYMMETRIC IMPELLER HUB FLOWPATH

(71) Applicant: Rolls-Royce Corporation, Indianapolis, IN (US)

(72) Inventor: Steven Mazur, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 145 days.

(21) Appl. No.: 16/104,605

(22) Filed: Aug. 17, 2018

(65) Prior Publication Data

US 2020/0056623 A1 Feb. 20, 2020

(51) Int. Cl.

| | |
|---|---|
| ***F04D 29/24*** | (2006.01) |
| ***F04D 29/28*** | (2006.01) |
| ***F04D 29/68*** | (2006.01) |
| ***F04D 29/22*** | (2006.01) |

(52) U.S. Cl.

CPC ..... *F04D 29/284* (2013.01); *F04D 29/2205* (2013.01); *F04D 29/24* (2013.01); *F04D 29/242* (2013.01); *F04D 29/245* (2013.01); *F04D 29/68* (2013.01); *F04D 29/681* (2013.01); *F05B 2240/301* (2013.01); *F05B 2250/16* (2013.01); *F05B 2250/73* (2013.01); *F05D 2240/305* (2013.01); *F05D 2240/306* (2013.01)

(58) Field of Classification Search

CPC .... F04D 29/284; F04D 29/30; F04D 29/2205; F04D 29/68; F04D 29/681; F04D 29/24; F04D 29/242; F04D 29/245

See application file for complete search history.

(56) References Cited

U.S. PATENT DOCUMENTS

| | | | | |
|---|---|---|---|---|
| 4,465,433 | A * | 8/1984 | Bischoff | F01D 5/141 415/181 |
| 6,017,186 | A * | 1/2000 | Hoeger | F01D 5/143 415/181 |
| 6,062,819 | A | 5/2000 | Zangeneh et al. | |
| 7,326,037 | B2 | 2/2008 | Eslinger | |
| 9,163,642 | B2 * | 10/2015 | Masutani | F04D 29/284 |

(Continued)

FOREIGN PATENT DOCUMENTS

| | | |
|---|---|---|
| CA | 2218692 C | 2/2008 |
| CA | 2566710 C | 4/2010 |

(Continued)

OTHER PUBLICATIONS

Extended European Search Report, European Application No. 19186714.2-1006, dated Dec. 20, 2019, 7 pages.

*Primary Examiner* — J. Todd Newton
*Assistant Examiner* — Andrew J Marien
(74) *Attorney, Agent, or Firm* — Barnes & Thornburg LLP

(57) ABSTRACT

A centrifugal impeller is disclosed having a non-axisymmetric flowpath surface. The centrifugal compressor may comprise a hub and a plurality of circumferentially spaced vanes. The hub has a flowpath surface and an axis of rotation. The plurality of circumferentially spaced vanes extend from the flowpath surface, with each of the vanes having a pressure-side fillet and a suction-side fillet extending from a leading edge to a trailing edge of the vane. The pressure-side fillet and suction-side fillet intersect the flowpath surface at a runout. The runout of the pressure-side fillet of a first vane is asymmetric to the runout of the suction-side fillet of the first vane.

15 Claims, 6 Drawing Sheets

(56) References Cited

U.S. PATENT DOCUMENTS

| | | | | |
|---|---|---|---|---|
| 2004/0005220 | A1* | 1/2004 | Kawamoto | F04D 29/284 416/223 R |
| 2004/0115044 | A1 | 6/2004 | Osako et al. | |
| 2008/0232968 | A1* | 9/2008 | Nguyen | F01D 5/145 416/193 R |
| 2012/0027599 | A1* | 2/2012 | Masutani | F04D 29/286 416/198 R |
| 2015/0125302 | A1* | 5/2015 | Roberto | F01D 5/141 416/183 |
| 2016/0154901 | A1 | 6/2016 | Cellier et al. | |
| 2017/0298951 | A1* | 10/2017 | Itoh | F04D 29/284 |

FOREIGN PATENT DOCUMENTS

| | | | |
|---|---|---|---|
| EP | 0865577 | B1 | 7/2002 |
| FR | 3008507 | A1 | 1/2015 |
| JP | 2008163760 | A1 | 7/2008 |
| JP | 2011080411 | A | 4/2011 |
| JP | 6310281 | B2 | 4/2018 |
| WO | 97/21035 | A1 | 6/1997 |

* cited by examiner

NON-AXISYMMETRIC IMPELLER HUB FLOWPATH

BACKGROUND

Centrifugal compressors are commonly used for fluid compression in rotating machines such as, for example, a gas turbine engine. Gas turbine engines typically include at least a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

A centrifugal compressor is a device in which a rotating rotor or impeller delivers air at relatively high velocity by the effect of centrifugal force on the gas within the impeller. The impeller typically comprises a plurality of vanes circumferentially spaced about a hub. Centrifugal impellers have complex three-dimensional flow structures due to turning of the flow in both the tangential and radial dimensions. Improvements to impeller geometries are desirable to increase impeller efficiency and uniformity of the gas flow exiting the impeller.

SUMMARY

According to some aspects of the present disclosure, a centrifugal impeller comprises a hub and a plurality of circumferentially spaced vanes. The hub has a flowpath surface and an axis of rotation. The plurality of circumferentially spaced vanes extend from the flowpath surface, each of the vanes having a pressure-side fillet and a suction-side fillet extending from a leading edge to a trailing edge of the vane. Each of the pressure-side fillet and suction-side fillet intersect the flowpath surface at a runout. The runout of the pressure-side fillet of a first vane is asymmetric to the runout of the suction-side fillet of the first vane.

In some embodiments the runout of the pressure-side fillet of a first vane is asymmetric to the runout of the suction-side fillet of an adjacent second vane. In some embodiments the runout of the pressure-side fillet of a first vane is asymmetric to the runout of the pressure-side fillet of an adjacent second vane. In some embodiments the runout of the pressure-side fillet of a first vane is asymmetric to the runout of the suction-side fillet of an adjacent second vane.

In some embodiments the runout of the pressure-side fillet of a first vane is asymmetric to the runout of the suction-side fillet of the first vane for a first portion of the length of the first vane, and wherein the runout of the pressure-side fillet of a first vane is symmetric to the runout of the suction-side fillet of the first vane for a second portion of the length of the first vane. In some embodiments the first portion is proximate an impeller discharge. In some embodiments a maximum asymmetry between the runout of the pressure-side fillet and the runout of the suction-side fillet is proximate the impeller discharge. In some embodiments a maximum asymmetry between the runout of the pressure-side fillet and the runout of the suction-side fillet is at a meridional position of 1.0.

In some embodiments the first portion is proximate a knee of the impeller. In some embodiments a maximum asymmetry between the runout of the pressure-side fillet and the runout of the suction-side fillet is proximate the knee. In some embodiments a maximum asymmetry between the runout of the pressure-side fillet and the runout of the suction-side fillet is at a meridional position of 0.5.

In some embodiments the centrifugal impeller further comprises a splitter vane disposed between the first vane and the second vane, the splitter vane extending from a knee of the impeller to a discharge of the impeller, the splitter vane having a pressure-side fillet and a suction-side fillet extending from a leading edge to a trailing edge of the splitter vane. In some embodiments the runout of the pressure-side fillet of the first vane is asymmetric the runout of the pressure-side fillet of the splitter vane. In some embodiments the runout of the pressure-side fillet of the first vane from the knee to the discharge of the impeller is symmetric to the runout of the pressure-side fillet of the splitter vane.

According to aspects of the present disclosures, a centrifugal impeller comprises a hub having a flowpath surface and an axis of rotation; and a plurality of circumferentially spaced vanes extending from the flowpath surface. Each of the vanes have a pressure-side fillet and a suction-side fillet extending from a leading edge to a trailing edge of the vane. A line at an intersection of the flowpath surface and the fillet along either the pressure side or the suction side of a first vane is non-parabolic.

In some embodiments the line at the intersection of the flowpath surface and the fillet along either the pressure side or the suction side of a first vane comprises a plurality of curves having differing foci.

According to further aspects of the present disclosure, a centrifugal impeller comprises a hub having a flowpath surface and an axis of rotation; and a plurality of circumferentially spaced vanes extending from the flowpath surface. A meridional cross-section of the hub comprises a flowpath surface that is non-axisymmetric about the axis of rotation of the hub.

In some embodiments the meridional cross-section is taken at a meridional position of 0.3. In some embodiments the meridional cross-section is taken at a meridional position of 0.5. In some embodiments the meridional cross-section is taken at a meridional position of 1.0.

BRIEF DESCRIPTION OF THE DRAWINGS

The following will be apparent from elements of the figures, which are provided for illustrative purposes.

Figure 1:
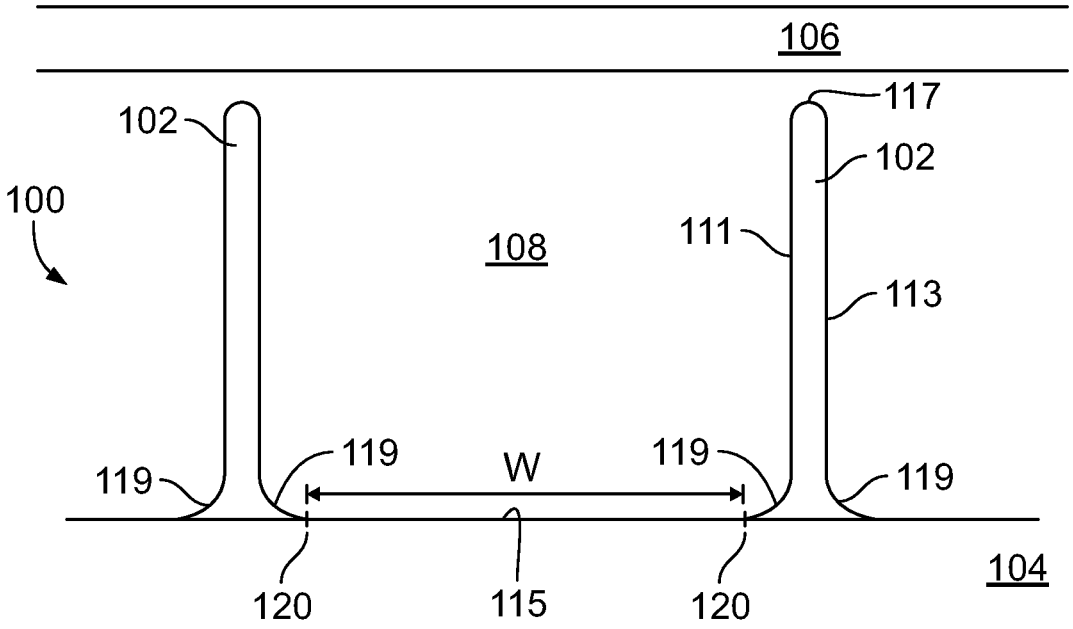
FIG. 1 is a cross-sectional view of a portion of a centrifugal impeller taken normal to an axis of rotation of the impeller and with the flowpath surface laid flat for clarity, in accordance with some embodiments of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments in the drawings and specific language will be used to describe the same.

The present disclosure is directed to improvements in the three-dimensional structure of a centrifugal impeller to increase impeller efficiency and uniformity of the gas flow exiting the impeller. Although the bulk flow of gas within the impeller largely follows the contours of the impeller vanes, many centrifugal impellers have significant secondary flow (such as cross-flow) due to high streamwise curvature in multiple planes and a long running length of the impeller. Reducing secondary flows may reduce losses in the impeller owed to such secondary flows and also improve uniformity of flow exiting the impeller. More specifically, the present disclosure is directed to a centrifugal impeller having a non-axisymmetric flowpath surface tailored to reduce vane-to-vane secondary flows in the impeller.

FIG. 1 is a cross-sectional view of a portion of a centrifugal impeller 100 taken normal to an axis of rotation A of the impeller 100 and with the flowpath surface 115 laid flat for clarity. It is understood that an unaltered flowpath surface 115 would be curved owing to the annular nature of the hub 104 when viewed normal to the axis. Impeller 100 comprises a plurality of vanes 102 circumferentially spaced about and coupled to a hub 104. Impeller 100 is at least partially encased by a shroud 106. In some embodiments, the impeller 100 may be a shrouded impeller, with the shroud integrally formed with or coupled to the vanes 102.

Each vane 102 extends from a leading edge 147 (shown on FIG. 3) to a trailing edge 148 (shown on FIG. 3) and comprises a pressure side 111 and suction side 113. Each vane 102 extends outward from the hub 104 and terminates at a vane tip 117. The vane tip 117 is typically spaced from the shroud 106 a sufficient distance to minimize or prevent contact between the vane 102 and shroud 106 during operation.

A fillet 119 is provided on both the pressure side 111 and suction side 113 to smoothly transition between the vane 102 and hub 104. The fillet 119 of the pressure side 111 (i.e. the pressure-side fillet) and the fillet 119 of the suction side 113 (i.e. the suction-side fillet) may each extend from the leading edge 147 to the trailing edge 148 of the vane. Each fillet 119 has a runout 120 defined at the intersection of the fillet 119 and the flowpath surface 115. The runout 120 thus comprises a line extending along the length of the fillet 119.

The hub 104 comprises an outwardly facing surface referred to as the flowpath surface 115. The flowpath surface 115 may face predominantly radially outward proximate an impeller inlet 122 (shown in FIG. 3) and may face predominantly axially forward proximate an impeller discharge 124 (shown in FIG. 3). The flowpath surface 115 extends between the runouts 120 of the fillets 119 of adjacent vanes 102, and has a width W illustrated in FIG. 1. When viewed normal to the axis, the runouts 120 may also be referred to as tangency points. The flowpath surface 115 may therefore be the exposed portion of the hub 104, which is to say the portion of the hub 104 that is contacted by fluid flowing through the impeller 100. The flowpath surface 115 of the hub 104 does not include the vanes 102 or fillets 119. The hub 104 has an axis of rotation that is the axis of rotation of the impeller 100. The hub 104 of known centrifugal impellers 100 is axisymmetric, i.e., symmetric about the axis of rotation.

Figure 3:
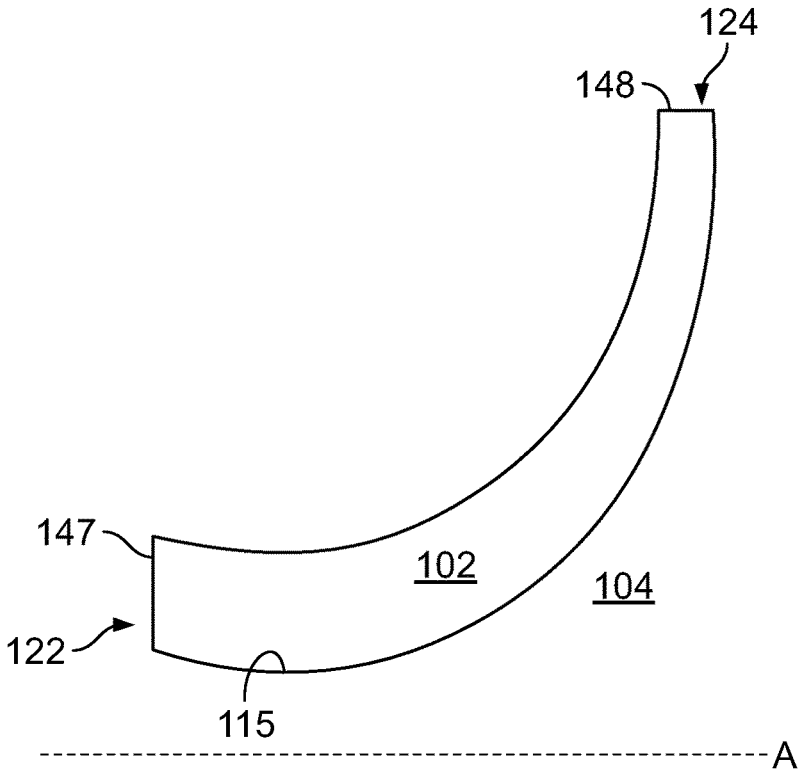
FIG. 3 is a cross-sectional view of a portion of the centrifugal impeller of FIG. 1 taken along a fillet-flowpath surface intersection, in accordance with some embodiments of the present disclosure.

FIG. 3 is a cross-sectional view of a portion of the centrifugal impeller 100 of FIG. 1 taken along the intersection of a fillet 119 and the flowpath surface 115 (i.e. along a runout 120). The flowpath surface 115 extends from an impeller inlet 122 to an impeller discharge 124 in a curved (e.g. parabolic) and axisymmetric manner. Design of the hub 104 often involves designating a curve between the impeller inlet 122 and impeller discharge 124 and then rotating the curve around the axis of rotation A to form a flowpath surface 115. The flowpath surface 115 may be parabolic in cross-section from inlet to discharge.

Figure 4:
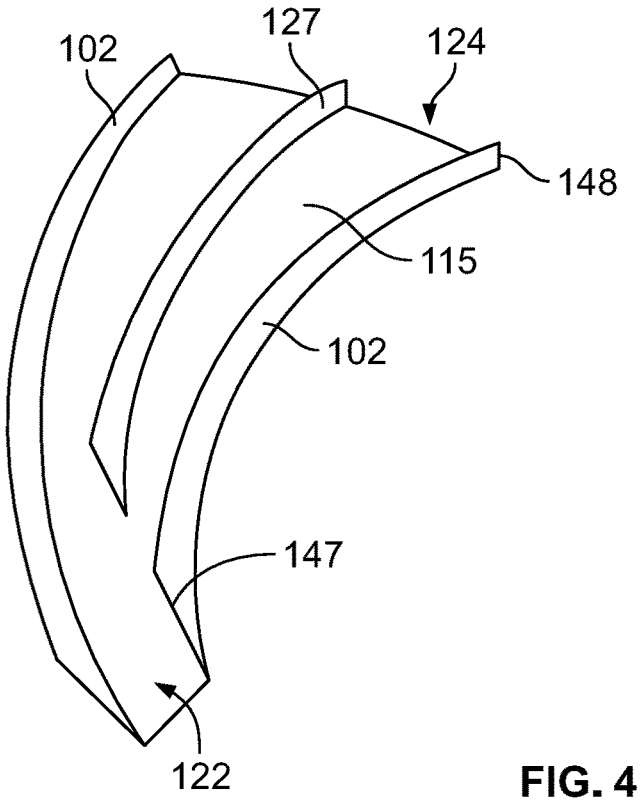
FIG. 4 is an isometric view of a portion of a centrifugal impeller in accordance with some embodiments of the present disclosure.

FIG. 4 provides an isometric view of a portion of a centrifugal impeller 100. The portion includes a pair of vanes 102 circumferentially spaced apart on the flowpath surface 115. The vanes 102 may extend from the impeller inlet 122 to the impeller discharge 124. A splitter vane 127 may be disposed between the vanes 102, and may extend from an intermediate meridional position to the impeller discharge 124. For example, the splitter vane 127 of FIG. 4 begins at a meridional position of approximately 0.3 or greater. The meridian of the impeller 100 extends from the impeller inlet 122 to the impeller discharge 124, such that the leading edge 147 is at a meridional position of 0.0 and the trailing edge 148 is at a meridional position of 1.0. A meridional cross-section is taken normal to the meridian.

Figure 2:
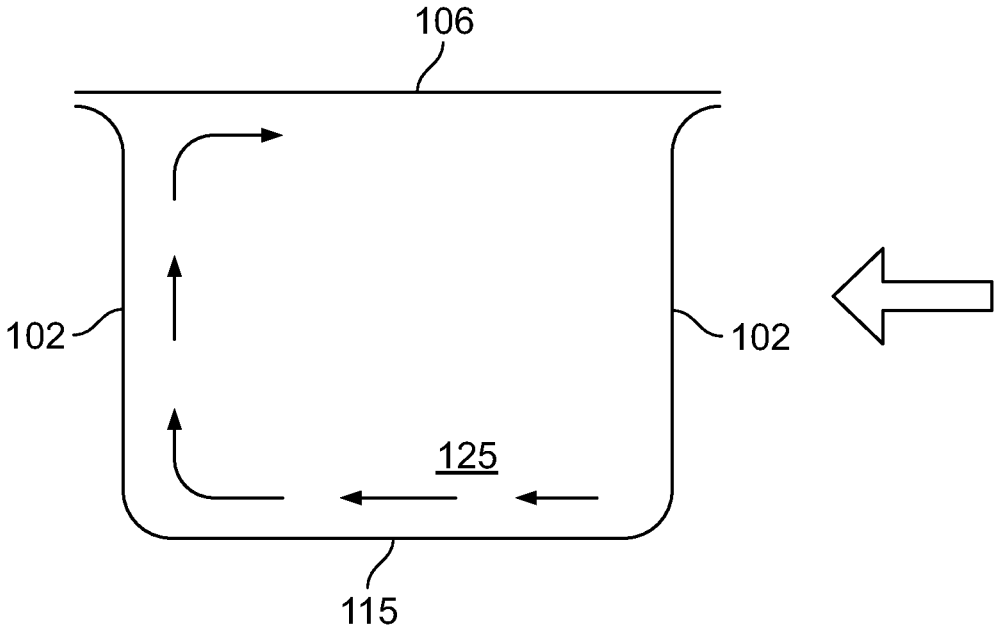
FIG. 2 is a profile view of the predominant secondary flow during operation of the centrifugal impeller of FIG. 1, in accordance with some embodiments of the present disclosure.

As shown in FIGS. 1 and 2, a fluid flowpath 108 is defined between the vanes 102, flowpath surface 115, and shroud 106. The vanes 102 predominantly provide circumferential bounding of the fluid flowpath 108, while the flowpath surface 115 is a radially inner boundary and the shroud 106 is a radially outer boundary. Due to the curvature of the flowpath surface 115 and shroud 106, proximate the impeller discharge 124 the flowpath surface 115 and shroud 106 may be axial boundaries rather than radial boundaries.

During operation, the impeller 100 is rotated at relatively high speeds about the axis of rotation. A fluid, typically air, is supplied at the impeller inlet 122 and flows through the fluid flowpath 108 to the impeller discharge 124.

Bulk flow of the fluid through the fluid flowpath 108 is, in FIG. 1, into the page. However, in addition to bulk flow, may centrifugal impellers 100 experience substantial levels of secondary flow. Secondary flows may cause flow losses—thus reducing the efficiency of the impeller 100—and reduce uniformity of fluid flow at the impeller discharge 124. FIG. 2 is a profile view of the predominant secondary flow 125 during operation of the centrifugal impeller 100 of FIG. 1. The illustrated impeller 100 is rotating from right to left.

The predominant secondary flow 125 is shown flowing from the lower pressure side 111 of a vane 102 toward the lower suction side 113 of an adjacent vane 102, along the flowpath surface 115. The predominant secondary flow 125 is then directed by the adjacent vane 102 in a radially outward direction and flows along the adjacent vane 102 toward the shroud 106. The predominant secondary flow 125 is then directed circumferentially along the shroud 106. This pattern of predominant secondary flow 125 may create substantially cross flow between the vanes 102 of an impeller 100.

Figure 5:
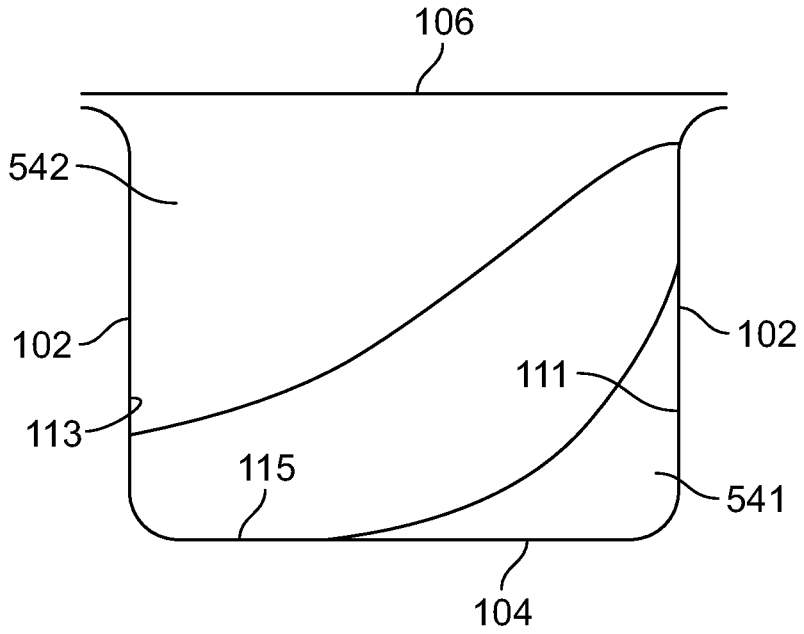
FIG. 5 is a profile view of the predominant secondary flow at a first meridional position during operation of the centrifugal impeller of FIG. 1, in accordance with some embodiments of the present disclosure.
Figure 6:
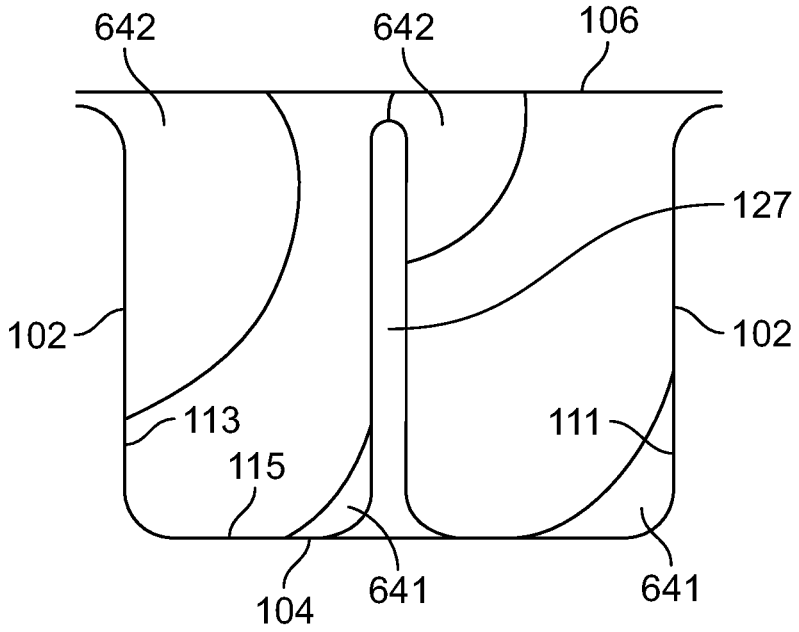
FIG. 6 is a profile view of the predominant secondary flow at a second meridional position during operation of the centrifugal impeller of FIG. 1, in accordance with some embodiments of the present disclosure.

FIGS. 5 and 6 each present additional examples of the inconsistent flow Mach numbers experienced during operation of impeller 100. FIG. 5 is a profile view of the predominant secondary flow at a first meridional position, and FIG. 6 is a profile view of the predominant secondary flow at a second meridional position, during operation of the centrifugal impeller of FIG. 1.

As shown in FIG. 5, a region of relatively low flow Mach number 541 may form along the lower pressure side 111 of a first vane 102 (shown on the right side of FIG. 5) and along the adjacent portions of the flowpath surface 115. A region of relatively high flow Mach number 542 may form along the suction side 113 of an adjacent vane 102 (shown on the left side of FIG. 5) and along adjacent portions of the shroud 106. As in FIG. 2, the pressure gradient between the region of relatively low flow Mach number 541 and the region of relatively high flow Mach number 542 may result in cross-flow or other secondary flows.

Similarly, FIG. 6 illustrates a pair of regions of relatively low flow Mach numbers 641 forming along the pressure side 111 of a vane 102 (shown on the right side of FIG. 6) and a splitter vane 127, and adjacent portions of the flowpath surface 115. Regions of relatively high flow Mach number 642 may form along the suction side 113 of an adjacent vane 102 (shown on the left side of FIG. 6) and along adjacent portions of the shroud 106. As in FIG. 2, the pressure gradient between the regions of relatively low flow Mach number 641 and the regions of relatively high flow Mach number 642 may result in cross-flow or other secondary flows.

Figure 7:
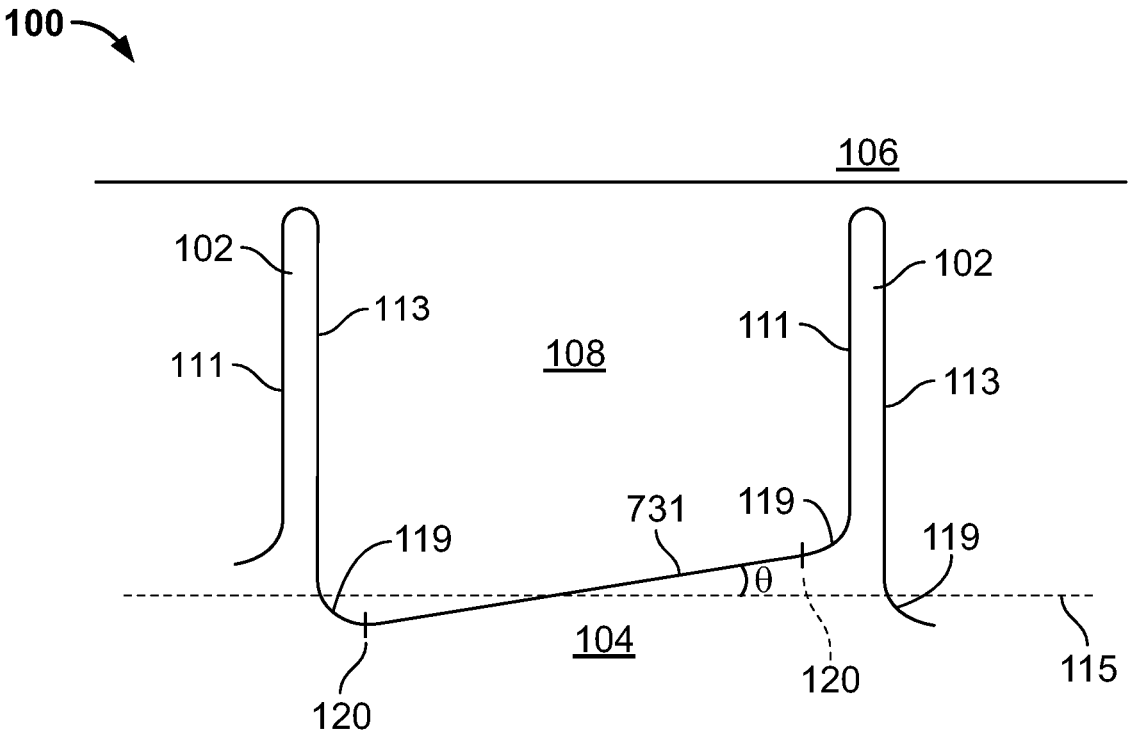
FIG. 7 is a cross-sectional view of a portion of a centrifugal impeller taken normal to an axis of rotation of the impeller and with the flowpath surface laid flat for clarity, in accordance with some embodiments of the present disclosure.

FIG. 7 provides a cross-sectional view of a portion of a centrifugal impeller 100 taken normal to an axis of rotation of the impeller 100 and laid flat for clarity, in accordance with some embodiments of the present disclosure. The illustrated centrifugal impeller 100 has a non-axisymmetric flowpath surface 731 tailored to reduce vane-to-vane secondary flows in the impeller 100.

An axisymmetric flowpath surface 115 such as that described with respect to FIG. 1 is illustrated as a dashed line. The flowpath surface 731 of the impeller 100 of FIG. 7 diverges from the axisymmetric flowpath surface 115 so as to be non-axisymmetric. The flowpath surface 731 may also be asymmetric when viewed in a meridional and/or axial plane. Further, the runout 120 of the fillet 119 on the pressure side 111 of a vane 102 may be asymmetric the runout 120 of the fillet 119 on the suction side 113 of the vane 102.

In the illustrated embodiment, the flowpath surface 731 extends linearly from the runout 120 of a fillet 119 on the pressure side 111 of a vane 102 to the runout 120 of a fillet 119 on the suction side 113 of an adjacent vane 102. The flowpath surface 731 may extend between the runouts 120 in a curvilinear or parabolic shape when viewed as a cross-section taken normal to the axis of rotation.

The runout 120 of the fillet 119 on the pressure side 111 is higher, or further from the axis of rotation, than the runout 120 of the fillet 119 on the suction side 113 of the adjacent vane 102. The runout 120 of the fillet 119 may be higher, or further from the axis of rotation, than an axisymmetric flowpath surface 115 proximate the pressure side 111 of a vane. Proximate the suction side 113 of a vane the runout 120 of the fillet 119 may be lower, or closer to the axis of rotation, than an axisymmetric flowpath surface 115. However, in some embodiments the runout 120 may be higher, or further from the axis of rotation, than an axisymmetric flowpath surface 115 proximate the suction side 113 of a vane while the runout 120 may be lower, or closer to the axis of rotation, than an axisymmetric flowpath surface 115 proximate the pressure side 111 of a vane.

The altered flowpath geometry presented in FIG. 7 may be used to reduce secondary flows through the flowpath 108. The flowpath surface 731 may be contoured to more closely align with the Mach number contours of impeller flow, such that the flowpath surface 731 or overall impeller geometry reduces the differences in Mach number to reduce secondary flows.

The divergence between non-axisymmetric flowpath surface 731 and axisymmetric flowpath surface 115 may be measured by an angle θ between the surfaces. In some embodiments, angle θ may be between 0 and 10 degrees.

The runout 120 along the fillet 119 of the pressure side 111 of a vane 102 may be asymmetric to the runout 120 along the fillet 119 of the suction side 113 of the same vane 102. The runout 120 along the fillet 119 of the pressure side 111 of a vane 102 may be asymmetric to the runout 120 along the fillet 119 of the suction side 113 of an adjacent vane 102.

Figure 8:
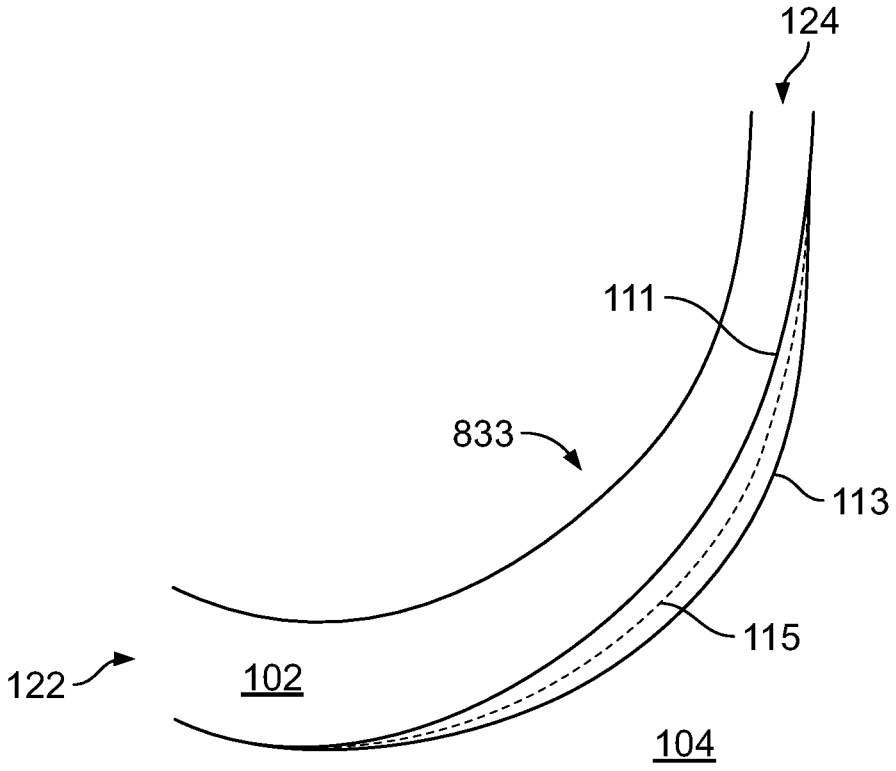
FIG. 8 is a cross-sectional view of a portion of the centrifugal impeller of FIG. 7 taken along the fillet-flowpath surface intersection on the pressure side of a vane and the suction side of an adjacent vane, in accordance with some embodiments of the present disclosure.
Figure 9:
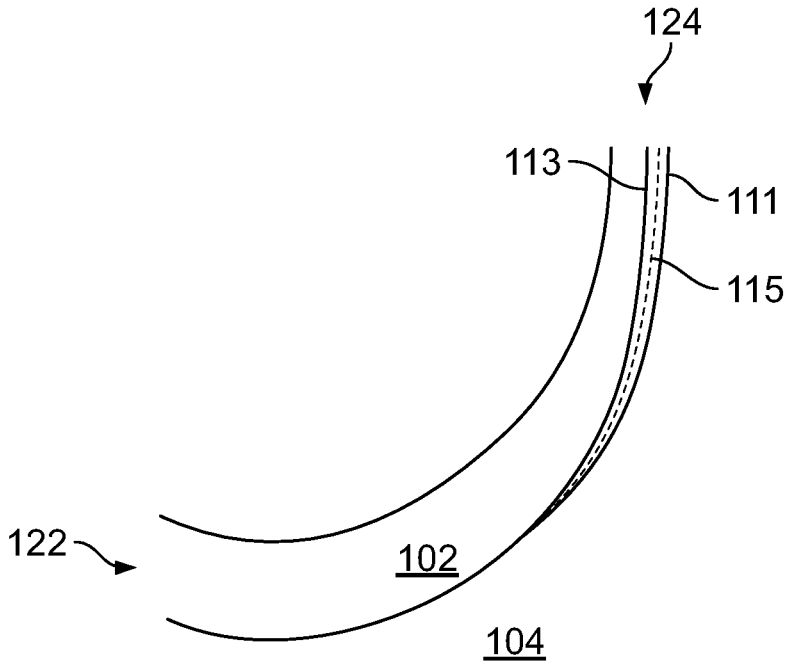
FIG. 9 is a cross-sectional view of a portion of a centrifugal impeller taken along the fillet-flowpath surface intersection on the pressure side of a vane and the suction side of an adjacent vane, in accordance with some embodiments of the present disclosure.

Departures from an axisymmetric flowpath surface 115 such as those depicted in FIG. 7 may extend fully from the impeller inlet 122 to the impeller discharge 124. However, such departures may also extend for limited portions of the length of the flowpath. FIGS. 8 and 9 provide cross-sectional views of a portion of the centrifugal impeller 100 of FIG. 7 taken along the fillet-flowpath surface intersection (i.e. along a runout 120) on the pressure side 111 of a vane 102 and the suction side 113 of an adjacent vane 102, in accordance with some embodiments of the present disclosure.

In the embodiment of FIG. 8, the runout 120 has a maximum departure from an axisymmetric flowpath surface 115 at a knee 833 of the impeller 100. The knee 833 may be at a meridional position of 0.5. In some embodiments, splitter vanes 127 may begin at the knee 833, and may extend from the knee 833 to the impeller discharge 124.

The flowpath surface 731 taken at the runout 120 on the pressure side 111 may be higher (further from the axis of rotation) than an axisymmetric flowpath surface 115. The flowpath surface 731 taken at the runout 120 on the suction side 113 may be lower (closer to the axis of rotation) than an axisymmetric flowpath surface 115. The flowpath surface 731 taken both proximate to the pressure side 111 and the suction side 113 may be non-parabolic.

The runout 120 may return to an axisymmetric and/or parabolic flowpath surface 115 proximate the impeller inlet 122 and/or impeller discharge 124. In the illustrated embodiment, the runouts 120 proximate the pressure side 111 and suction side 113 each return to an axisymmetric and parabolic flowpath surface 115 at a meridional position of approximately 0.2 and 0.8. In some embodiments, the runout 120 may return to an axisymmetric and/or parabolic flowpath surface 115 at a first meridional position proximate the pressure side 111 and at a second meridional position proximate the suction side 113.

The runout 120 may have a maximum departure from an axisymmetric flowpath surface 115 at knee 833. The runout 120 may have a maximum departure from an axisymmetric flowpath surface 115 at a meridional position of 0.5. In some embodiments, the runout 120 may have a maximum departure from an axisymmetric flowpath surface 115 at a meridional position of between 0.2 and 0.8.

The axisymmetric flowpath surface 115 of FIG. 8 may be parabolic. The runouts 120 at the pressure side 111 and suction side 113 may be non-parabolic. The runouts 120 at the pressure side 111 and suction side 113 may comprise a plurality of curves having different foci.

When the meridional position is considered in quartiles, the embodiment of FIG. 8 presents a runout that is axisymmetric for at least a portion of the first and fourth quartiles while also non-axisymmetric for at least a portion of the second and third quartiles.

FIG. 8 may also depict the pressure side 111 and suction side 113 of the same vane 102. Thus the runouts 120 depicted in FIG. 8 illustrate that a flowpath surface 731 along the fillet 119 of the pressure side 111 of a vane 102 may be asymmetric to the flowpath surface 731 along the fillet 119 of the suction side 113 of the same vane 102 or an adjacent vane 102. The asymmetry may extend along the full length of the vane 102, or may extend for only a portion of the length of the vane 102. For example, runout 120 along the fillet 119 of the pressure side 111 of a vane 102 may be asymmetric to runout 120 along the fillet 119 of the suction side 113 of the same vane 102 or an adjacent vane 102 for a first portion of the length of the vane 102. The runout 120 along the fillet 119 of the pressure side 111 of a vane 102 may be symmetric to runout 120 along the fillet 119 of the suction side 113 of the same vane 102 or an adjacent vane 102 along a second portion of the vane 102.

In the embodiment of FIG. 8, the first portion may be proximate the knee 833 and/or a meridional position of 0.5. The maximum asymmetry between runout 120 along the fillet 119 of the pressure side 111 of the vane 102 and runout 120 along the fillet 119 of the suction side 113 of the same vane 102 may be proximate the knee 833 and/or a meridional position of 0.5.

In some embodiments, such as that presented in FIG. 9, the runout 120 has a maximum departure from an axisymmetric flowpath surface 115 proximate or at the impeller discharge 124. The runout 120 may have a maximum departure from an axisymmetric flowpath surface 115 proximate or at a meridional position of 1.0.

The flowpath surface 731 taken at the runout 120 on the suction side 113 may be higher than and/or axially forward from an axisymmetric flowpath surface 115. The flowpath surface 731 taken at the runout 120 on the pressure side 111 may be lower than and/or axially aft of an axisymmetric flowpath surface 115. The flowpath surface 731 taken both proximate to the pressure side 111 and the suction side 113 may be non-parabolic.

The flowpath surface 731 may diverge from an axisymmetric and/or parabolic flowpath surface 115 proximate the knee 833 and/or a meridional position of 0.5. The flowpath surface 731 may begin to diverge from an axisymmetric and/or parabolic flowpath surface 115 at a point between a meridional position of 0.4 and 0.6. In some embodiments, the flowpath surface 731 may begin to diverge from an axisymmetric and/or parabolic flowpath surface 115 at a first meridional position proximate the pressure side 111 and at a second meridional position proximate the suction side 113. The flowpath surface 731 may be axisymmetric and/or parabolic between the leading edge of a vane 102 and the leading edge of the splitter vane 127, and then begin to diverge from an axisymmetric and/or parabolic flowpath surface 115 at the leading edge of the splitter vane 127.

The flowpath surface 731 of FIG. 9 may improve the flow quality and/or uniformity at the impeller discharge 124, and thus improve flow quality and/or uniformity of flow into a centrifugal diffuser or deswirler.

The axisymmetric flowpath surface 115 of FIG. 9 may be parabolic. The runouts 120 at the pressure side 111 and suction side 113 may be non-parabolic. The runouts 120 at the pressure side 111 and suction side 113 may comprise a plurality of curves having different foci.

When the meridional position is considered in quartiles, the embodiment of FIG. 9 presents a runout that is axisymmetric for at least a portion of the first and second quartiles while also non-axisymmetric for at least a portion of the third and fourth quartiles.

FIG. 9 may also depict the pressure side 111 and suction side 113 of the same vane 102. Thus the runouts 120 depicted in FIG. 8 illustrate that a runout 120 along the fillet 119 of the pressure side 111 of a vane 102 may be asymmetric to runout 120 along the fillet 119 of the suction side 113 of the same vane 102 or an adjacent vane 102. The asymmetry may extend along the full length of the vane 102, or may extend for only a portion of the length of the vane 102. For example, a runout 120 along the fillet 119 of the pressure side 111 of a vane 102 may be asymmetric to the runout 120 along the fillet 119 of the suction side 113 of the same vane 102 or an adjacent vane 102 for a first portion of the length of the vane 102. The runout 120 along the fillet 119 of the pressure side 111 of a vane 102 may be symmetric to the runout 120 along the fillet 119 of the suction side 113 of the same vane 102 or an adjacent vane 102 along a second portion of the vane 102.

In the embodiment of FIG. 9, the first portion may be proximate the impeller discharge 124 and/or a meridional position of 1.0. The maximum asymmetry between the runout 120 along the fillet 119 of the pressure side 111 of the vane 102 and the runout 120 along the fillet 119 of the suction side 113 of the same vane 102 may be proximate the impeller discharge 124 and/or a meridional position of 1.0.

Figure 10:
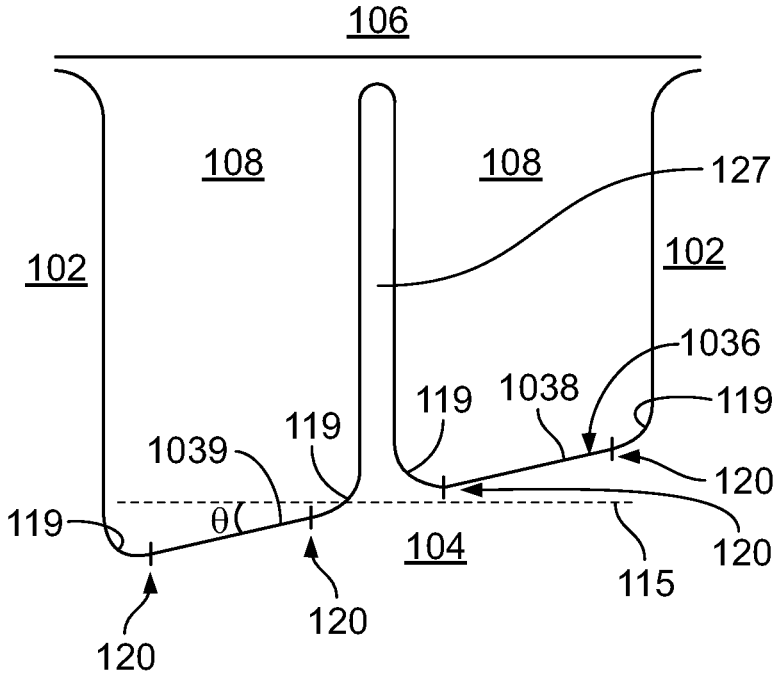
FIG. 10 is a cross-sectional view of a portion of a centrifugal impeller taken normal to an axis of rotation of the impeller and with the flowpath surface laid flat for clarity, in accordance with some embodiments of the present disclosure.

The divergence from an axisymmetric flowpath surface 115, such as that shown by flowpath surface 731 of FIG. 7, may continue with a splitter vane 127 disposed between the adjacent vanes 102. Such an embodiment is illustrated in FIG. 10. The splitter vane 127 may extend from a leading edge 147 to a trailing edge 148 and comprising a fillet 119 on each of the pressure side 111 and suction side 113. The splitter vane 127 may extend from the knee 833 and/or a meridional position proximate 0.5 to the impeller discharge 124 and/or a meridional position proximate 1.0. In some embodiments the splitter vane 127 extends from a meridional position of 0.3 or 0.35 to the impeller discharge 124 and/or a meridional position proximate 1.0.

A flowpath surface 1036 extends generally from a runout 120 on the pressure side 111 of a vane 102 to the runout 120 on the suction side 113 of an adjacent vane 102 and is intersected by a splitter vane 127. The flowpath surface 1036 is thus defined as a first portion 1038 extending between the runout 120 on the pressure side 102 of a vane 102 and the runout 120 on the suction side 113 of a splitter vane 127, and a second portion 1039 extending between the runout 120 on the pressure side 102 of a splitter vane 127 and the runout 120 on the suction side 113 of a vane 102.

The divergence between non-axisymmetric flowpath surface 1036 and axisymmetric flowpath surface 115 may be measured by an angle θ between the surfaces. In some embodiments, angle θ may be between 0 and 10 degrees.

As shown in FIG. 10, the runout 120 at a fillet 119 of the pressure side 111 of a vane 102 may be asymmetric with the runout 120 at each of the fillets 119 at the suction side 113 and pressure side 111 of an adjacent splitter vane 127 and the suction side 113 of an adjacent vane 102.

In still further embodiments, the runout 120 at a fillet 119 of the pressure side 111 of a vane 102 may be asymmetric the runout 120 at a fillet 119 of the pressure side 111 of an adjacent vane 102.

The divergence from an axisymmetric flowpath surface 115 such as that shown by flowpath surface 731 of FIG. 7 may be determined between any two adjacent vanes 102, to include an adjacent vane 102 and splitter vane 127. Such an embodiment is illustrated in FIG. 11.

Figure 11:
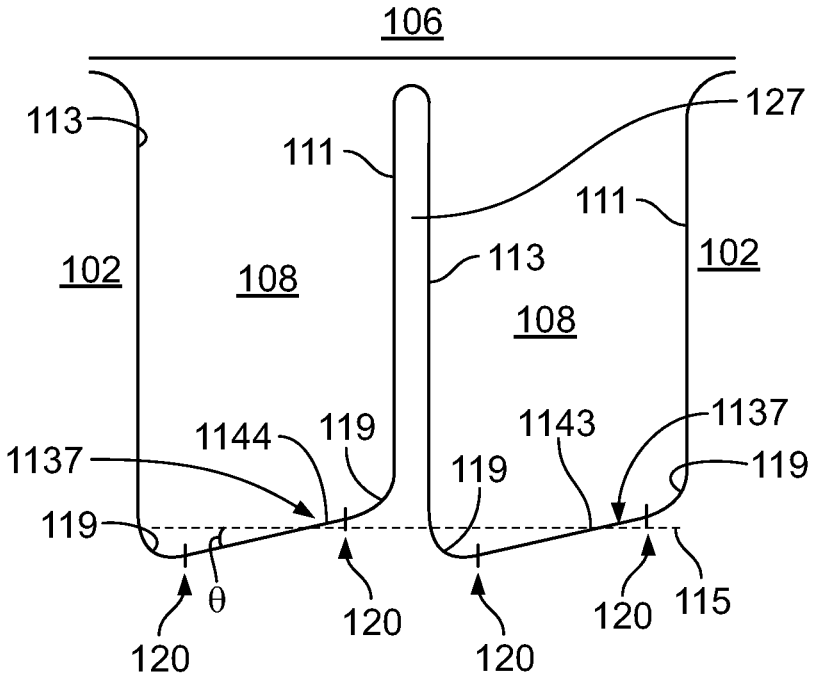
FIG. 11 is a cross-sectional view of a portion of a centrifugal impeller taken normal to an axis of rotation of the impeller and with the flowpath surface laid flat for clarity, in accordance with some embodiments of the present disclosure.

In FIG. 11, a flowpath surface 1137 comprises a first flowpath surface segment 1143 and a second flowpath surface segment 1144. The first flowpath surface segment 1143 extends between a runout 120 on a pressure side 111 of a vane 102 and a runout 120 on a suction side 113 of a splitter vane 127. The second flowpath surface segment 1144 extends between a runout 120 on a pressure side 111 of a splitter vane 127 and a runout 120 on a suction side 113 of a vane 102.

The runout 120 on the pressure side 111 of vane 102 and the runout 120 on the pressure side 111 of splitter vane 127 may have a common divergence from an axisymmetric flowpath surface 115 (i.e. may be equally distant from the axis of rotation). Similarly, the runout 120 on the suction side 113 of a splitter vane 127 and the runout 120 on the suction side 113 of a vane 102 may have a common divergence from an axisymmetric flowpath surface 115 (i.e. may be equally distant from the axis of rotation). However in some embodiments the runouts 120 on a common side of adjacent vanes and/or splitter vanes may have varying divergences from an axisymmetric flowpath surface 115.

As shown in FIG. 11, the runout 120 at a fillet 119 of the pressure side 111 of a vane 102 may be asymmetric with the runout 120 at the fillet 119 at the suction side 113 of an adjacent splitter vane 127 and the suction side 113 of an adjacent vane 102. The runout 120 at a fillet 119 of the pressure side 111 of a vane 102 may be symmetric with the runout 120 at the fillet 119 at the pressure side 111 of an adjacent splitter vane 127 and the fillet 119 at the pressure side 111 of an adjacent vane 102.

In still further embodiments, the runout 120 at a fillet 119 of the pressure side 111 of a vane 102 may be asymmetric the runout 120 at a fillet 119 of the pressure side 111 of an adjacent vane 102.

In some embodiments the divergence between non-axisymmetric flowpath surface 1137 and axisymmetric flowpath surface 115 may be measured by an angle θ between the surfaces. In some embodiments, angle θ may be between 0 and 10 degrees. In some embodiments the divergence as measured by an angle θ may be different between the first flowpath surface segment 1143 and the second flowpath surface segment 1144.

As described above with reference to FIG. 7, the embodiments of FIGS. 10 and 11 may be used to reduce secondary flows through the flowpath 108 and/or improve secondary flows proximate the impeller discharge 124.

The present disclosure provides many advantages over existing centrifugal impellers. The disclosed centrifugal impeller may obtain an improved efficiency and uniformity of gas discharge by adjusting the flowpath surface of the hub to more evenly distribute flow Mach numbers between the impeller vanes. More evenly distributed flow Mach numbers may reduce the tendency of cross flow to form from regions of relative low flow Mach number to regions of relatively high flow Mach number.

The present disclosure also provides for influencing cross flow and secondary flows of an impeller without altering or substantially altering the geometry of an impeller shroud and/or the impeller vanes. Thus a consistent vane profile is presented to the shroud, and the present disclosure does not increase the risk of impingement of the vanes against the shroud.

Although examples are illustrated and described herein, embodiments are nevertheless not limited to the details shown, since various modifications and structural changes may be made therein by those of ordinary skill within the scope and range of equivalents of the claims.

What is claimed is:

1. A centrifugal impeller comprising:

a hub having a flowpath surface and an axis of rotation; and a plurality of circumferentially spaced vanes extending from said flowpath surface, each of the plurality of circumferentially spaced vanes having a pressure-side fillet and a suction-side fillet extending from a leading edge to a trailing edge of the vane, each of the pressure-side fillet and suction-side fillet intersecting the flowpath surface at a runout, wherein the runout of the pressure-side fillet of each vane is asymmetric to the runout of the suction-side fillet of each vane such that the runout of the pressure-side fillet is spaced further from the axis of rotation than an axisymmetric flowpath line and the runout of the suction-side fillet is spaced closer to the axis of rotation than the axisymmetric flowpath line, and wherein the plurality of circumferentially spaced vanes includes a first vane and an adjacent second vane spaced apart circumferentially from the first vane such that the flowpath surface extends between the first vane and the adjacent second vane at an angle relative to an axisymmetric flowpath line between a suction side of the first vane and a pressure side of the adjacent second vane.

2. The centrifugal impeller of claim 1 wherein the runout of the pressure-side fillet of the first vane is asymmetric to the runout of the suction-side fillet of the adjacent second vane such that the runout of the pressure-side fillet of the first vane is spaced further from the axis of rotation than the axisymmetric flowpath line and the runout of the suction-side fillet of the second vane is spaced closer to the axis of rotation than the axisymmetric flowpath line.

3. The centrifugal impeller of claim 1 wherein the runout of the pressure-side fillet of the first vane is asymmetric to the runout of the pressure-side fillet of the adjacent second vane such that the runout of the pressure-side fillet of the first vane is spaced further from the axis of rotation than the runout of the pressure-side fillet of the second vane.

4. The centrifugal impeller of claim 3 wherein the runout of the pressure-side fillet of the first vane is asymmetric to the runout of the suction-side fillet of the adjacent second vane such that the runout of the pressure-side fillet of the first vane is spaced further from the axis of rotation than the axisymmetric flowpath line and the runout of the suction-side fillet of the second vane is spaced closer to the axis of rotation than the axisymmetric flowpath line.

5. The centrifugal impeller of claim 1 wherein the runout of the pressure-side fillet of each vane is asymmetric to the runout of the suction-side fillet of each vane for a first portion of the length of each vane, and wherein the runout of the pressure-side fillet of each vane is symmetric to the runout of the suction-side fillet of each vane for a second portion of the length of each vane.

6. The centrifugal impeller of claim 5 wherein the first portion is proximate an impeller discharge, the second portion is proximate an impeller inlet, and a maximum asymmetry between the runout of the pressure-side fillet and the runout of the suction-side fillet is proximate the impeller discharge.

7. The centrifugal impeller of claim 5 wherein the first portion is proximate a knee of the impeller and wherein a maximum asymmetry between the runout of the pressure-side fillet and the runout of the suction-side fillet is proximate the knee.

8. The centrifugal impeller of claim 1 further comprising a splitter vane disposed between the first vane and the second vane, the splitter vane extending from a knee of the impeller to a discharge of the impeller, the splitter vane having a pressure-side fillet and a suction-side fillet extending from a leading edge to a trailing edge of the splitter vane.

9. The centrifugal impeller of claim 8 wherein the runout of the pressure-side fillet of the first vane is asymmetric the runout of the pressure-side fillet of the splitter vane such that the runout of the pressure-side fillet of the first vane is spaced outward of the runout of the pressure-side fillet of the splitter vane relative to the axisymmetric flowpath line.

10. The centrifugal impeller of claim 8 wherein the runout of the pressure-side fillet of the first vane from the knee to the discharge of the impeller is symmetric to the runout of the pressure-side fillet of the splitter vane.

11. The centrifugal impeller of claim 5 wherein the runout of the pressure-side fillet of the first vane is symmetric to the runout of the suction-side fillet of the first vane for a third portion of the length of the first vane of the length of each vane.

12. The centrifugal impeller of claim 11 wherein the second portion is proximate an impeller inlet and the third portion is proximate an impeller discharge.

13. A centrifugal impeller comprising:

a hub having a flowpath surface and an axis of rotation; and a plurality of circumferentially spaced vanes extending away from the flowpath surface and extending along the flowpath surface from an inlet of the impeller to a discharge of the impeller along a axisymmetric flowpath line that is parabolic, each of the plurality of circumferentially spaced vanes having a pressure-side fillet and a suction-side fillet extending from a leading edge to a trailing edge of the vane, wherein a line at an intersection of the flowpath surface and the pressure-side fillet extending between the inlet of the impeller and the discharge of the impeller is non-parabolic and a line at an intersection of the flowpath surface and the suction-side fillet extending between the inlet of the impeller and the discharge of the impeller is non-parabolic, and wherein the line at the intersection of the flowpath surface and the pressure-side fillet is spaced further from the axis of rotation than the axisymmetric flowpath line and the line at the intersection of the flowpath surface and the suction-side fillet is spaced closer to the axis of rotation than the axisymmetric flowpath line.

14. The centrifugal impeller of claim 13 wherein the line at the intersection of the flowpath surface and the pressure-side fillet and the line at the intersection of the flowpath surface and the suction-side fillet each comprises a plurality of curves having differing foci.

15. The centrifugal impeller of claim 13 wherein the line at the intersection of the flowpath surface and the pressure-side fillet and the line at the intersection of the flowpath surface and the suction-side fillet are offset from the axisymmetric flowpath line along a first portion, and wherein the line at the intersection of the flowpath surface and the pressure-side fillet and the line at the intersection of the flowpath surface and the suction-side fillet are symmetric with the axisymmetric flowpath line along a second portion.

* * * * *